United States Patent [19]

Anthonsen et al.

[11] Patent Number: 4,729,945

[45] Date of Patent: Mar. 8, 1988

[54] MULTILAYER PHOTOGRAPHIC SUPPORT MATERIAL

[75] Inventors: Reiner Anthonsen, Bramsche; Wieland Sack, Bissendorf, both of Fed. Rep. of Germany

[73] Assignee: Felix Schoeller, Jr., Fed. Rep. of Germany

[21] Appl. No.: 910,786

[22] Filed: Sep. 23, 1986

Related U.S. Application Data

[63] Continuation of Ser. No. 522,817, Aug. 12, 1983, abandoned, which is a continuation-in-part of Ser. No. 315,034, Oct. 26, 1981, abandoned.

[51] Int. Cl.[4] ..... G03C 1/76

[52] U.S. Cl. ..... 430/538; 430/531; 430/532; 430/536

[58] Field of Search ..... 430/531, 532, 536, 538

[56] References Cited

U.S. PATENT DOCUMENTS

| | | | |
|---|---|---|---|
| 3,072,483 | 1/1963 | Trevoy et al. | 430/532 |
| 3,411,908 | 11/1968 | Crawford et al. | 430/532 |
| 3,582,338 | 6/1971 | Yost et al. | 430/532 |
| 3,973,963 | 8/1976 | Venor et al. | 430/532 |
| 4,269,937 | 5/1981 | Asanuma et al. | 430/538 |
| 4,283,486 | 8/1981 | Aono et al. | 430/538 |
| 4,311,774 | 1/1982 | Raphael | 430/538 |
| 4,364,971 | 12/1982 | Sack et al. | 430/532 |
| 4,384,040 | 5/1983 | Von Meer | 430/532 |

OTHER PUBLICATIONS

Cramm and Bibee, "The Theory and Practice of Corona Treatment for Improving Adhesion", T.A.P.P.I., vol. 15, No. 8, pp. 75–78 (Aug. 1982).

*Primary Examiner*—Jack P. Brammer

*Attorney, Agent, or Firm*—Allegretti, Newitt, Witcoff & McAndrews, Ltd.

[57] ABSTRACT

A method for making a support paper for a photographic emulsion having a smooth unmottled surface which comprises applying to the top side of a photographic base paper pigmented monomeric liquid, acrylic coating mixture, hardening the mixture by bombarding with a beam of electrons at room temperature and extruding a pigmented polyolefin film over the hardened mixture to serve as a barrier against migration of unpolymerized monomer into the emulsion. The hardened acrylic resin is preferably oxidized by corona treatment to facilitate adhesion of the polyolefin.

16 Claims, 2 Drawing Figures

*COMPOSITION OF MULTILAYER PHOTOGRAPHIC ELEMENT*

COMPOSITION OF MULTILAYER PHOTOGRAPHIC ELEMENT

PHOTOGRAPHIC DENSITY CURVES

MULTILAYER PHOTOGRAPHIC SUPPORT MATERIAL

This application is a continuation of application Ser. No. 522,817, filed Aug. 12, 1983, now abandoned, which is a continuation-in-part of Ser. No. 315,034, filed Oct. 26, 1981, now abandoned.

This invention relates to a method for making a support material for photographic coatings, especially a waterproof support material, which has a core consisting of paper and a smooth even surface inert to a photographic emulsion applied to said material.

BACKGROUND OF THE INVENTION

Photographic support materials consist of film, or of paper, or of coated paper. Film supports are preferred when a high surface quality is demanded, or the flexibility of the material and the cost play a subordinate role, or when an image is to be viewed or used in transmitted light. This is especially true for negative materials, which in general have a lesser thickness and must be transparent.

Positive materials are for reasons of use frequently thicker and are viewed in incident light. They are therefore based preferably on paper, which is still sufficiently flexible, even at a greater thickness, and which possesses the necessary opacity for the viewing of an image in incident light. Photographic papers normally carry a white pigmented covering coating, the composition of which is decisive for the image definition of the photographic image produced in the overlying photosensitive coating.

Rapid and automated processing procedures for the production of positive photographic images utilize to an increasing degree waterproof coated papers. In particular, papers prepared according to German Pat. No. 14 47 815 having both sides coated with extruded synthetic resin serve as supports for a great variety of photographic coatings. The synthetic resin coating disposed between the paper and the overlying photographic coatings contains a light-reflecting white pigment, for example titanium dioxide, and may also contain graduating dyes (shading dyes) and/or optical brighteners and/or other functional additives such as lubricants, antistatic materials, age-resistant agents, etc.

Preferred synthetic resin coatings used are polyolefins, the particular advantage of which consists in the fact that they can be effectively prepared by a simple corona treatment bonding the photographic coatings. Moreover, polyolefin coatings are photochemically inert and economical to produce.

A disadvantage of all support materials on a paper base produced by extrusion coating is the relatively low content of white pigment in the pigmented covering layer. Polyolefinic extrusion coating materials contain not more than about 20% by weight titanium dioxide, because at higher pigment contents it is not possible to produce a cohesive film coating.

A further disadvantage of extrusion-coated support materials arises from the high temperature required to extrude the resin which is deposited on the paper in the molten state at approximately 300° C. Extrusion of polyolefin coatings on a paper support is suggested in U.S. Pat. No. 4,283,486, which patent also suggests coating from a solvent solution of the polymer and drying by hot air. As a consequence of the sudden heating-up of the paper surface by either of these methods, a dehydration of the cellulose fibers situated at the surface takes place. This sudden dehydration and the partial reconditioning of the fibers that sets in after cooling are accompanied by an undesired, finely-dented deformation of the paper surface, which is reflected in the overlying synthetic resin coating. Consequently, melt-coated photographic paper supports always exhibit a surface structure which may be described as fine uneveness, which manifests itself in the photographic image as "mottle", that is a cloudy turbulence.

A further cause of uneveness on a synthetic resin coating produced on paper by extrusion coating from the melt with subsequent cooling at a roll surface is attributable to the non-homogeneity of the coated paper core. Corresponding to the density fluctuations in the paper, a variably-strong bond of the synthetic resin coating to the cooling roll is produced, and when the coated paper is separated from the cooling roll deformation forces of varying strength act upon the surface of the still plastic synthetic resin coating.

The disadvantages in regard to surface structure and image definition of such papers coated with thermoplastic resin coatings can be overcome according to copending U.S. applications Ser. No. 273,110, now U.S. Pat. No. 4,364,971 and Ser. No. 273,111, now U.S. Pat. No. 4,384,040 by coating the base paper with hardenable resin mixtures, the hardening of which is carried out using electron rays at room temperature. Waterproof photographic paper supports produced in such manner give rise, on account of increased pigmentation, to photographic images of good image definition. Further they do not have the uneven surface which copies the paper structure and which can manifest itself in the finished photographic image as "mottle".

A disadvantage of such support materials having one or more coatings of mixtures hardened by electron ray is, however, that a small proportion of monomeric compounds always remains behind in the coating. These may be monomers that were not cured during the electron radiation hardening, or depolymerization products. It is believed that other reactions take place upon exposure to the radiation which generate radicals that form peroxides, or acrylic acid which is reduced to acrolein. It is possible also that destructive particles can be generated from the sizing on the base paper. The proportion of these mostly volatile, but in any case mobile chemical compounds of different structure, is relatively low, but they will migrate to the photosensitive emulsion. On account of their chemical reactivity, these compounds can adversely affect the photographic coatings and in particular vary their sensitivity during storage. Even usual bond-promoting coatings on a base of gelatins, or mixtures of gelatins with other polymers, have not proved to be adequate barriers for preventing migration of these harmful reactive compounds. Even a subsequently applied coating of polyethylene foil did not prevent migration and the consequent adverse effect on the overlying photographic layer.

THE INVENTION

It is an object of the present invention to produce a waterproof, photographic support element, which possesses the mechnical properties of a paper support, has an invariably plane surface, does not exert any harmful influence upon the overlying photosensitive coatings and in use provides photographic images of good definition.

The object is achieved by applying to one face of a support paper, a pigmented liquid acrylic resin coating hardenable by electron rays, and hardening the coating by exposure to electrons at room temperature, and extruding a pigmented polyolefin resin onto said hardened coating. Preferably the paper is also coated on the underside with a waterproof synthetic resin such as a pigmented or unpigmented polyolefin. Preferably, the acrylic coating hardened by electron rays is subjected to a surface treatment to facilitate adhesion of the overlying extruded coating.

The coating initially applied on one face and hardened by electron rays is preferably a pigmented binder and has a weight per unit area of 5 to 40 g/m$^2$, preferably 15 to 30 g/m$^2$.

The resin binder consists essentially of acrylic acid esters containing C=C double bonds, and can consequently be polymerizingly hardened by means of accelerated electron rays without a catalyst. Polymerization catalysts will adversely affect the photosensitive emulsion and penetrate the polyolefin barrier. As mentioned above, this method of hardening leaves behind a small proportion of monomeric and other compounds which affect the sensitivity of the photographic emulsion. Small proportions of non-hardenable polymers or low-molecular substances can be contained in the binder mixtures, provided such additives improve specific properties and do not basically modify the character of a mixture hardened by electron rays.

Preferred pigments in the acrylic coating are white pigments, for example titanium dioxide, barium sulphate, zinc oxide, and calcium carbonate. For special applications, color pigments or carbon black, either alone or together with the white pigments, may also be contained in the coating.

The acrylic coating, after hardening by electron rays, is subjected at the surface to an oxidizing treatment to facilitate adhesion and thereafter is covered by extrusion coating with 8 to 40 g/m$^2$ (preferably 12 to 25 g/m$^2$) or a polyolefin layer. This resin is pigmented and serves as a barrier to block migration of monomers or depolymerization products to the overlying photographic emulsion. The surface treatment known in the art is mostly simply carried out by a corona or flame treatment. Ultraviolet radiation, or ozone, may also be used, as well as various kinds of wet oxidizing chemical (e.g. according to U.S. Pat. No. 3,317,330).

After the oxidizing surface treatment of the acrylic layer, this layer is coated with pigmented polyolefin barrier by the melt extrusion process at temperatures of 280° to 320° C. by means of a fishtail die. As the polyolefin, polyethylene is preferably used, but it may also be an ethylene copolymer with a predominant ethylene content or indeed polypropylene. Furthermore, mixtures of polyolefin with small additions of other polymeric substances, for example polyethylene with approximately 5% polystyrene resin, are especially suitable. The base paper is insulated from the heat of the extruded polyolefin by the hardened acrylic coating.

The polyolefin coating material contains as a rule 5 to 20% by weight of one or more white pigments. Preferred white pigments are titanium dioxide of the rutile or anatase types. Mixtures of titanium dioxide with calcium carbonate and/or zinc oxide are also suitable. In addition, small quantities of blue, violet or red color pigments may also be added to the mixture for the purpose of adjusting specific white graduations. Optical brighteners and other functional additives may also be added in a small quantity to the polyolefin layer.

For special applications, especially for use as negative material for silver salt diffusion processes, the polyolefin layer may also contain carbon black in proportions of 0.5 to 8% by weight.

The surface of the polyolefin layer is likewise subjected to an oxidizing surface treatment and/or is coated with a bond-promoting layer to prepare it for accepting the photosensitive coating.

The under or rearside of the multilayer support material is provided in the usual way with a polyolefin coating or protected by other suitable coatings against the penetration of photographic baths. The structure and composition of the rear face coating is not critical for purposes of this invention.

THE DRAWINGS

Figure 1:
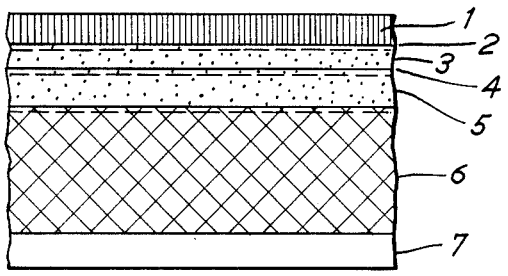
FIG. 1 is a cross sectional view of a multilayer support prepared in accordance with this invention.

In FIG. 1, reference 1 denotes the photographic emulsion layer, which in turn may consist of several layers, e.g., each of 1 to 2 microns in thickness. Reference 2 denotes the bond-promoting layer on the oxidized surface of the polyolefinic layer, reference 3 the polyolefinic layer, reference 4 the treated boundary surface of the acrylic layer hardened by electron radiation, reference 5 the acrylic layer hardened by electron radiation, reference 6 the photographic base paper having a water-repellant internal sizing and/or a surface sizing and reference 7 finally denotes the sealing rear face layer, which in turn may be either single or composite.

The invention is explained in more detail with reference to the following examples thereof.

SPECIFIC EXAMPLES

Example 1

An approximately 170 g/m$^2$ weight photographic base paper, internally sized with alkyl ketene dimer and carrying a conducting surface coating containing $Na_2SO_4$, was coated by means of a doctor blade with approximately 15 g/m$^2$ of a mixture that can be hardened by electron radiation. The composition of the mixture was:

40% by wt. polyester acrylate
(MW=approx. 1000 with 4 double bonds per molecule)
10% by wt. polystyrene resin
(MW=approx. 350)
20% by wt. oligotriacrylate
(MW=approx. 480)
10% by wt. hexane diol diacrylate
20% by wt. $TiO_2$rutile The coating was hardened under nitrogen or other inert gas by electron rays with an energy dose of 40 J/g. Following this, the surface was subjected in known manner to a corona treatment and coated by extrusion coating with approximately 25 g/m$^2$ of a pigment-containing polyethylene mixture. The composition of this polyethylene mixture was:

85% by wt. polyethylene
(density 0.924, melt flow index 4)
15% by wt. titanium dioxide, rutile 0.1% by wt. ultramarine blue.

EXAMPLE 2

An approximate 170 g/m² photographic base paper was coated by a doctor blade with approximately 7 g/m² of a mixture hardenable by electron rays. The composition of the mixture was the same of that of Example 1. The coating was hardened as in Example 1 with an energy dose of 40 J/g and, after corona treatment of the surface, was coated with approximately 30 g/m² of the same polyethylene mixture as in Example 1.

EXAMPLE 3

An approximate 170 g/m² photographic base paper was coated by means of a doctor blade with approximately 25 g/m² of a mixture hardenable by electron rays. The composition of the mixture was the same of that of Example 1. The coating was hardened as in Example 1 with an energy dose of 40 J/g and, after corona treatment of the surface, was coated with approximately 15 g/m² of the same polyethylene mixture as in Example 1.

EXAMPLE 4

An approximate 160 g/m² photographic base paper was coated on one face with approximately 20 g/m² of a mixture hardenable by electron rays. The composition of the mixture was:

43% by wt. polyester acrylate
(MW=approx. 1000 with 4 double bonds per molecule)
22% by wt. hexane diol diacrylate
20% by wt. oligotriacrylate
15% by wt. titanium dioxide
0.007% by wt. of blue graduating dye
0.003% by wt. of violet graduating dye.

The coating was pressed, according to the method described in copending application Ser. No. 273,110, filed June 12, 1981, now U.S. Pat. No. 4,364,971, against a cooled high-gloss cylinder, was hardened from the rear side of the paper by accelerated electron rays using an energy dose of 30 J/g and, after hardening, was separated from the cylinder. The coating hardened by electron rays was then subjected to a corona treatment as in Example 1 and subsequently coated with approximately 20 g/m² of the same polyethylene mixture was stated in Example 1.

EXAMPLE 5

An approximate 160 g/m² photographic base paper was coated on one face with approximately 35 g/m² of a mixture hardenable by electron rays. The composition of the mixture was:

25% by wt. polyester acrylate
5% by wt. hydroxy ethyl acrylate
20% by wt. neopentyl glycol diacrylate
10% by wt. oligotriacrylate
40% by wt. calcium carbonate.

The coating was covered according to a variant of the method described in U.S. Pat. No. 4,364,971 with a polyester foil, was hardened from the rear face of the paper by accelerated electron rays at an energy dose of 50 J/g and, after hardening, was separated from the polyester foil. The layer hardened by electron rays was subsequently subjected at the surface to a flame treatment according to German Pat. No. 2,138,033 and thereafter coated with approximately 10 g/m² of a polyethylene mixture. The composition of the polyethylene mixture, applied by extrusion coating using a fishtail die, was:

85% by wt. polyethylene
(density 0.923, melt flow index 4)
14% by wt. titanium dioxide (anatase)
1% by wt. calcium carbonate
0.07% by wt. ultramarine blue
0.1% by wt. optical brightener
2,5-di(5-tert.butyl-benzoxazolyl-2')thiophene

REFERENCE EXAMPLE A

An approximate 170 g/m² photographic base paper was coated by means of extrusion coating on one face with approximately 40 g/m² of a polyethylene mixture. The composition of the mixture was:

85% by wt. polyethylene
15% by wt. titanium dioxide, rutile
0.1% by wt. ultramarine blue.

REFERENCE EXAMPLES B–F

As further reference examples, the same base papers as in Examples 1 to 5 were taken and each coated on the front face with approximately 30 g/m² of the mixture that can be hardened by electron radiation set forth in those examples and were hardened by means of electron rays in the same manner was stated in Examples 1 to 5.

The papers of Examples 1 to 5 were uniformly coated on the non-coated rear face with 30 g/m² of a polyethylene mixture, the composition of which was:

75% by wt. low-pressure polyethylene
(density 0.96, melt flow index 10)
25% by wt. High-pressure plyethylene
(density 0.92, melt flow index 4).

REFERENCE EXAMPLE G

An approximate 170 g/m² photographic base paper was first coated with an aqueous solution of polyvinyl chloride in an amount of 15 g/m² in accordance with U.S. Pat. No. 4,283,486. The coating was dried by hot air, and thereafter coated on both sides with polyethylene as described in Reference Example A.

TESTS

For carrying out the photographic tests, examples and reference examples were each treated on the first coated front face with a high-frequency corona, and were coated with a usual photographic emulsion, intended for black-and-white processing, based on gelatin and silver halides.

Figure 2:
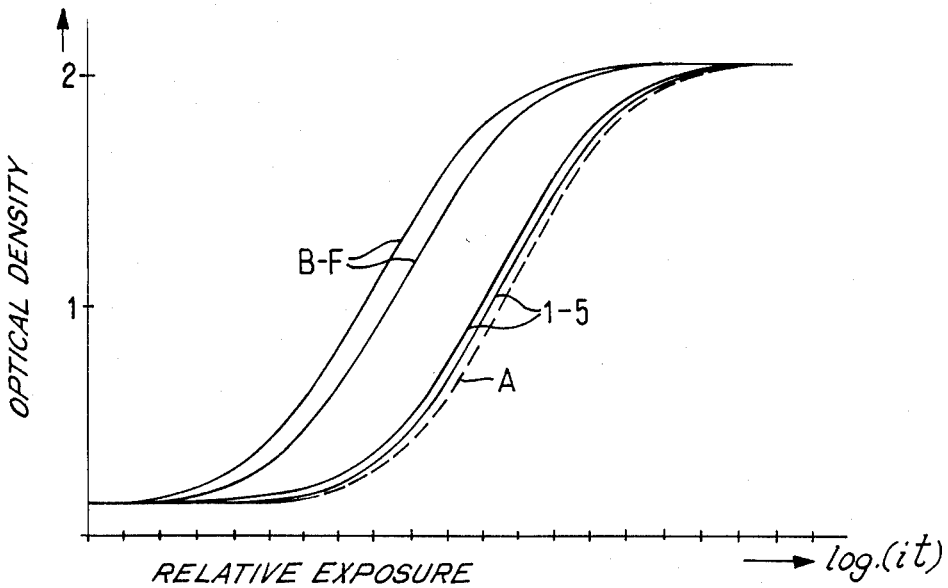
FIG. 2 is a graph illustrating the photographic density of various papers described in the specific examples.

After three months storage time, a grey wedge was exposed onto the thus produced photographic materials, they were developed and the photographic density curve for this grey wedge was graphically plotted (FIG. 2).

These photographic density curve exhibit, for unchanged graduation, a variation in the sensitivity for Reference Examples B–F, which are coated on the front face with the acrylate resin coating hardened by electron rays only, whereas the examples according to this invention do not exhibit any sensitivity variation and correspond virtually to Reference Example A.

In a further test, the photosensitively coated materials were weakly exposed, developed to a medium grey tone and subsequently the cloudy perturbation ("mottle") in the grey surface was comparatively assessed. It was found that Reference Example A (only polyethylene coating) exhibited relatively the most pronounced "mottle", whereas the examples according to this invention exhibited a visibly greater uniformity.

Additional comparative tests of the surface quality of support materials (without photosensitive coating) confirmed the surprising fact that the examples according to this invention are clearly superior to Reference Example A in respect of surface quality. The method of determining the surface quality is described in U.S. Pat. No. 4,364,971. A selection of the test results is summarized in Table 1. "Fog density" is a measure of the darkening of the film which occurs without the effect of light, e.g. in storage. The measurement is made with a densitometer by a method described in ARSI Standard PH 2.2-1966 (R 1972). The higher the number the greater the darkening.

TABLE 1

| | Selected Test Results | | | |
|---|---|---|---|---|
| Example | Surface Quality | "Mottle" | Change in Sensitivity After 3 months | Fog Density |
| 1 | 28 | slight | 0 | 0.15 |
| 2 | 25 | slight | 0 | 0.15 |
| 3 | 30 | slight | 0 | 0.17 |
| 4 | 70 | very slight | 0 | 0.16 |
| 5 | 73 | very slight | 0 | 0.16 |
| A | 19 | moderately strong | 0 | 0.16 |
| B | 33 | slight | + | 0.24 |
| C | 32 | slight | + | 0.24 |
| D | 34 | slight | + | 0.25 |
| E | 73 | very slight | + | 0.26 |
| F | 78 | very slight | + | 0.26 |
| G | 20 | strong | 0 | 0.16 |

Paper weights of 160 and 170 g/m$^2$ are named in the examples. The invention is, however, advantageously suitable in an analogous manner for papers down to 50 g/m$^2$ and also for heavier papers up to, for instance, 250 g/m$^2$. The coating and the hardening of the mixtures hardenable by electron rays is carried out at room temperature without external supply of heat, so that the paper is very carefully treated.

The melt extrusion coating, for the polyolefin barrier, takes place at temperatures, as already mentioned, between 280° and 320° C.

What is claimed is:

1. A method for preparing a multilayer photographic support material using at least one coating mixture and accelerated electron radiation to provide a smooth unmottled surface, wherein harmful reactive products that remain after exposure to the accelerated electron radiation are rendered inert to a photographic silver halide emulsion subsequently applied onto said surface, comprising in combination:

applying to at least one surface of a photographic base paper a liquid acrylic coating mixture consisting essentially of liquid acrylic acid esters containing two or more C=C double bonds and characterized by molecular weights of about 1000 or less, hardenable by electron radiation; and containing a pigment, hardening said liquid acrylic coating mixture in a polymerization reaction by irradiation with accelerated electrons at substantially room temperature in an inert gas atmosphere or covered with an inert solid material to polymerize a layer of acrylic polymer onto said surface, said layer of acrylic polymer including harmful reactive products that remain after the exposure to electron radiation, and said acrylic layer further including a hardening surface, subjecting said hardened surface to oxidizing treatment selected from the group consisting of corona, flame, ozone, ultraviolet radiation or wet oxidizing chemical treatment to facilitate adhesion to a subsequent coating, melt extrusion coating onto said treated hardened surface a film of pigmented polyolefin resin; and applying onto the polyolefin resin a coating that includes a silver-halide photographic emulsion.

2. The method of claim 1 in which said hardening step is performed with said liquid coating mixture in contact with a smooth surface.

3. The method of claim 2 in which said smooth surface is the surface of a metallic cylinder.

4. The method of claim 1 in which said smooth surface is the surface of a metallic belt.

5. The method of claim 2 in which said smooth surface is the surface of a film sheet of synthetic resin.

6. The method of claim 1 in which said applied liquid acrylic coating mixture hardenable by electron radiation contains at least one compound containing three or more acrylic C=C double bonds.

7. The method of claim 1 in which the pigment in said polyolefin coating mixture is predominately titanium dioxide.

8. The method of claim 1 in which said oxidation treatment is a corona treatment.

9. The method of claim 1 in which said oxidation treatment is a flame-treatment.

10. The method of claim 1 in which said oxidation treatment is an ultraviolet-treatment.

11. The method of claim 1 in which a waterproof coating is also applied to the opposite face of said sheet of paper.

12. The method of claim 1 in which said inert gas is nitrogen.

13. The method of claim 11 in which said waterproof coating is a film of polyolefin resin applied by means of extrusion.

14. The method of claim 11 in which said acrylic coating mixture hardenable by electrons contains a non-acrylic resin and is hardened under an inert gas.

15. The method of claim 7 in which said acrylic coating mixture also contains a colored pigment.

16. The method of claim 11 in which the acrylic coating mixture is hardened in the absence of a catalyst.

* * * * *